US006778953B1

(12) United States Patent
Edler et al.

(10) Patent No.: US 6,778,953 B1
(45) Date of Patent: Aug. 17, 2004

(54) METHOD AND APPARATUS FOR REPRESENTING MASKED THRESHOLDS IN A PERCEPTUAL AUDIO CODER

(75) Inventors: Bernd Andreas Edler, Niedersachsen (DE); Christof Faller, Taegerwilen (CH); Gerald Dietrich Schuller, Chatham, NJ (US)

(73) Assignee: Agere Systems Inc., Allentown, PA (US)

( * ) Notice: Subject to any disclaimer, the term of this patent is extended or adjusted under 35 U.S.C. 154(b) by 601 days.

(21) Appl. No.: 09/586,071

(22) Filed: Jun. 2, 2000

(51) Int. Cl.[7] ..... G10L 19/00

(52) U.S. Cl. ..... 704/200.1; 704/219; 704/220; 704/230; 704/503; 704/205

(58) Field of Search ..... 704/201, 200.1, 704/220, 219, 230, 205, 243, 500–504, 203, 240, 211, 222, 227

(56) References Cited

U.S. PATENT DOCUMENTS 5,623,577 A * 4/1997 Fielder ..... 704/200.1
5,675,701 A * 10/1997 Kleijn et al. ..... 704/222
5,687,282 A * 11/1997 Van De Kerkhof ..... 704/205
5,778,335 A * 7/1998 Ubale et al. ..... 704/219
5,781,888 A * 7/1998 Herre ..... 704/200.1
5,787,390 A * 7/1998 Quinquis et al. ..... 704/219
5,956,674 A * 9/1999 Smyth et al. ..... 704/200.1
6,035,177 A * 3/2000 Moses et al. ..... 725/22
6,094,636 A * 7/2000 Kim ..... 704/500
6,233,550 B1 * 5/2001 Gersho et al. ..... 704/208
6,260,010 B1 * 7/2001 Gao et al. ..... 704/230
6,330,533 B2 * 12/2001 Su et al. ..... 704/220
6,424,939 B1 * 7/2002 Herre et al. ..... 704/219
6,453,282 B1 * 9/2002 Hilpert et al. ..... 704/200.1
6,453,289 B1 * 9/2002 Ertem et al. ..... 704/225
6,475,245 B2 * 11/2002 Gersho et al. ..... 704/208
6,480,822 B2 * 11/2002 Thyssen ..... 704/220
6,493,665 B1 * 12/2002 Su et al. ..... 704/230
6,499,010 B1 * 12/2002 Faller ..... 704/229
6,507,814 B1 * 1/2003 Gao ..... 704/220

FOREIGN PATENT DOCUMENTS

EP 0 987 827 A2 9/1999

OTHER PUBLICATIONS

Akune et al., "Super Bit Mapping: Psychoacoustically Optimized Digital Recording," 93rd AES Convention, San Franciso, CA (Oct. 1992).
Brandenburg, K., "MP3 and AAC Explained," AES 17th International Conference, pp. 99–110 (1999).
Edler et al., "Audio Coding Using a Psychoacoustic Pre– and Post–Filter," IEEE International Conference on Acoustics, Speech and Signal Processing, Proceedings, vol. 2, pp. 881–884 (Jun. 2000).

* cited by examiner

*Primary Examiner*—Vijay Chawan

(57) ABSTRACT

A method and apparatus are disclosed for representing the masked threshold in a perceptual audio coder, using line spectral frequencies (LSF) or another representation for linear prediction (LP) coefficients. The present invention calculates LP coefficients for the masked threshold using known LPC analysis techniques. In one embodiment, the masked thresholds are optionally transformed to a non-linear frequency scale suitable for auditory properties. The LP coefficients are converted to line spectral frequencies or a similar representation in which they can be quantized for transmission. In one implementation, the masked threshold is transmitted only if the masked threshold is significantly different from the previous masked threshold. In between each transmitted masked threshold, the masked threshold is approximated using interpolation schemes. The present invention decides which masked thresholds to transmit based on the change of consecutive masked thresholds, as opposed to the variation of short-term spectra.

21 Claims, 5 Drawing Sheets

METHOD AND APPARATUS FOR REPRESENTING MASKED THRESHOLDS IN A PERCEPTUAL AUDIO CODER

CROSS-REFERENCE TO RELATED APPLICATIONS

The present invention is related to United States Patent Application Ser. No. 09/586,072 entitled "Perceptual Coding of Audio Signals Using Separated Irrelevancy Reduction and Redundancy Reduction,", United States Patent Application Ser. No. 09/586,070 entitled "Perceptual Coding of Audio Signals Using Cascaded Filterbanks for Performing Irrelevancy Reduction and Redundancy Reduction With Different Spectral/Temporal Resolution,", United States Patent Application Ser. No. 09/586,069 entitled "Method and Apparatus for Reducing Aliasing in Cascaded Filter Banks," and United States Patent Application Ser. No. 09/586,068 entitled "Method and Apparatus for Detecting Noise-Like Signal Components," filed contemporaneously herewith, assigned to the assignee of the present invention and incorporated by reference herein.

FIELD OF THE INVENTION

The present invention relates generally to audio coding techniques, and more particularly, to perceptually-based coding of audio signals, such as speech and music signals.

BACKGROUND OF THE INVENTION

Perceptual audio coders (PAC) attempt to minimize the bit rate requirements for the storage or transmission (or both) of digital audio data by the application of sophisticated hearing models and signal processing techniques. Perceptual audio coders (PAC) are described, for example, in D. Sinha et al., "The Perceptual Audio Coder," Digital Audio, Section 42, 42-1 to 42-18, (CRC Press, 1998), incorporated by reference herein. In the absence of channel errors, a PAC is able to achieve near stereo compact disk (CD) audio quality at a rate of approximately 128 kbps. At a lower rate of 96 kbps, the resulting quality is still fairly close to that of CD audio for many important types of audio material.

Perceptual audio coders reduce the amount of information needed to represent an audio signal by exploiting human perception and minimizing the perceived distortion for a given bit rate. Perceptual audio coders first apply a time-frequency transform, which provides a compact representation, followed by quantization of the spectral coefficients. FIG. 1 is a schematic block diagram of a conventional perceptual audio coder 100. As shown in FIG. 1, a typical perceptual audio coder 100 includes an analysis filterbank 110, a perceptual model 120, a quantization and coding block 130 and a bitstream encoder/multiplexer 140.

The analysis filterbank 110 converts the input samples into a sub-sampled spectral representation. The perceptual model 120 estimates a masked threshold of the signal. For each spectral coefficient, the masked threshold gives the maximum coding error that can be introduced into the audio signal while still maintaining perceptually transparent signal quality. The quantization and coding block 130 quantizes and codes the spectral values according to the precision corresponding to the masked threshold estimate. Thus, the quantization noise is hidden by the respective transmitted signal. Finally, the coded spectral values and additional side information are packed into a bitstream and transmitted to the decoder by the bitstream encoder/multiplexer 140.

FIG. 2 is a schematic block diagram of a conventional perceptual audio decoder 200. As shown in FIG. 2, the perceptual audio decoder 200 includes a bitstream decoder/demultiplexer 210, a decoding and inverse quantization block 220 and a synthesis filterbank 230. The bitstream decoder/demultiplexer 210 parses and decodes the bitstream yielding the coded spectral values and the side information. The decoding and inverse quantization block 220 performs the decoding and inverse quantization of the quantized spectral values. The synthesis filterbank 230 transforms the spectral values back into the time-domain.

In perceptual audio coders, such as the perceptual audio coder 100 shown in FIG. 1, the masked threshold is used to control the quantization and encoding of subband signals by the quantization and coding block 130. FIG. 3 illustrates a masked threshold 310 computed according to a psychoacoustic model and the corresponding approximation 320 used by a conventional perceptual audio coder. As shown in FIG. 3, the masked threshold is usually approximated with a step function that is encoded and transmitted to the perceptual audio decoder as side information. Due to limited bandwidth in the side information, however, only a course approximation of the masked threshold is transmitted. Inadequate accuracy of the masked threshold representation impacts the perceptual quality.

A need therefore exists for methods and apparatus for representing the masked threshold more accurately. A further need exists for methods and apparatus for representing the masked threshold more accurately with as few bits as possible.

SUMMARY OF THE INVENTION

Generally, a method and apparatus are disclosed for representing the masked threshold in a perceptual audio coder, using line spectral frequencies (LSF) or another representation for linear prediction (LP) coefficients. The present invention calculates LP coefficients for the masked threshold using known LPC analysis techniques. In one embodiment, the masked thresholds are optionally transformed to a non-linear frequency scale suitable for auditory properties. The LP coefficients are converted to line spectral frequencies (LSF) or a similar representation in which they can be quantized for transmission.

According to one aspect of the invention, the masked threshold is represented more accurately in a perceptual audio coder using an LSF notation previously applied in speech coding techniques. According to another aspect of the invention, the masked threshold is transmitted only if the masked threshold is significantly different from the previous masked threshold. In between each transmitted masked threshold, the masked threshold is approximated using interpolation schemes. The present invention decides which masked thresholds to transmit based on the change of consecutive masked thresholds, as opposed to the variation of short-term spectra.

The present invention provides a number of options for modeling variations in the masked threshold over time. For signal parts that gradually change, the masked threshold changes gradually as well and can be approximated by interpolation. For a generally stationary signal part, followed by a sudden change, the masked threshold can be approximated by a constant masked threshold that changes at once. A relatively constant masked threshold that later changes gradually can be modeled by a combination of a constant masked threshold followed by interpolation. A stationary signal part with a short transient in the middle has a masked threshold that temporarily changes to another value but returns to the initial value. This case can be modeled efficiently by setting the masked threshold after the transient to the masked threshold before the transient, and thus not transmitting the masked threshold after the transient.

A more complete understanding of the present invention, as well as further features and advantages of the present invention, will be obtained by reference to the following detailed description and drawings.

DETAILED DESCRIPTION

The present invention provides a method and apparatus for representing the masked threshold in a perceptual audio coder. The present invention represents the masked threshold coefficients using line spectral frequencies (LSF). As discussed below in a section entitled "Masked Threshold Viewed as a Power Spectrum," it is known that linear prediction coefficients can be used to model spectral envelopes. Generally, the present invention calculates the LP coefficients for the masked threshold using known LPC analysis techniques, that were previously applied only to short-term spectra. The masked thresholds can optionally be transformed to a non-linear frequency scale that is more suited to auditory properties. The LP coefficients that model the masked threshold are then converted to line spectral frequencies (LSF) or a similar representation in which they can be quantized for transmission.

Thus, according to one feature of the present invention, the masked threshold is represented more accurately in a perceptual audio coder using an LSF notation previously applied in speech coding techniques. According to another feature of the present invention, a method is disclosed that adaptively transmits a masked threshold only if it is significantly different from the previous one, thereby further reducing the number of bits to be transmitted. In between each transmitted masked threshold, the masked threshold is approximated using interpolation schemes.

Perceptual Audio Coding Principles

Figure 1:
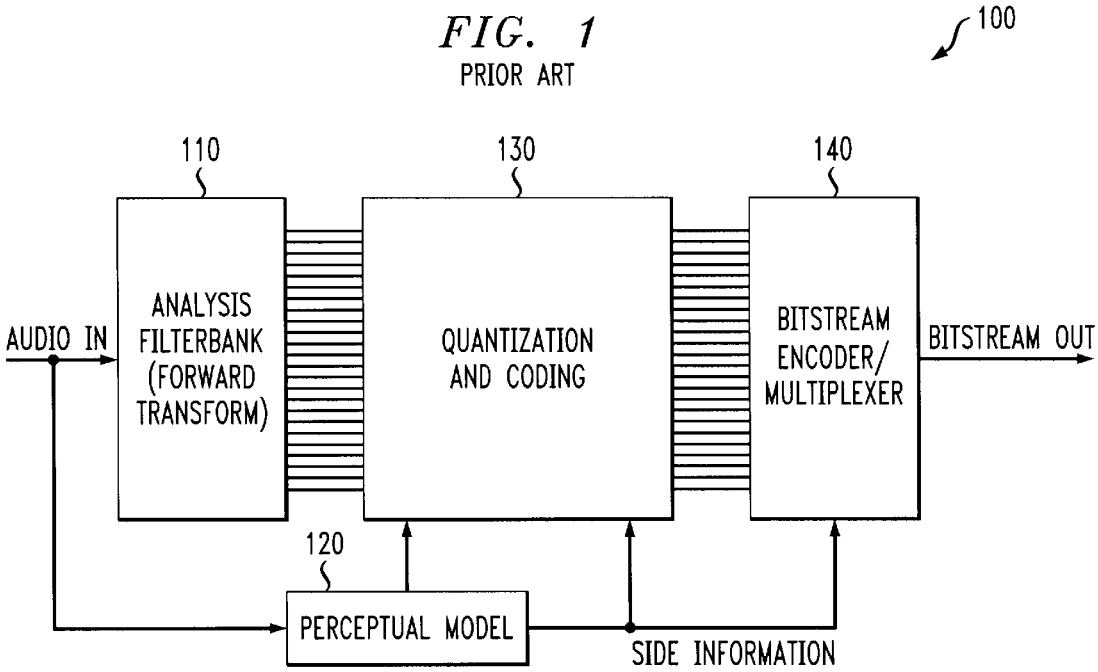
FIG. 1 PRIOR ART
FIG. 1 is a schematic block diagram of a conventional perceptual audio coder.
Figure 2:
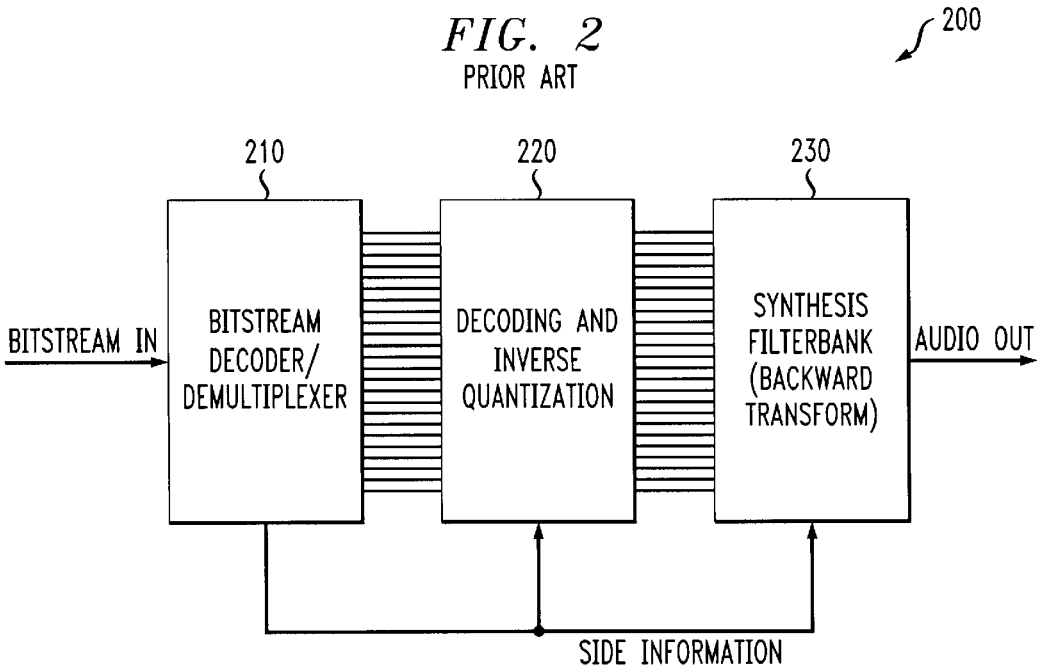
FIG. 2 PRIOR ART
FIG. 2 is a schematic block diagram of a conventional perceptual audio decoder corresponding to the perceptual audio coder of FIG. 1.
Figure 4:
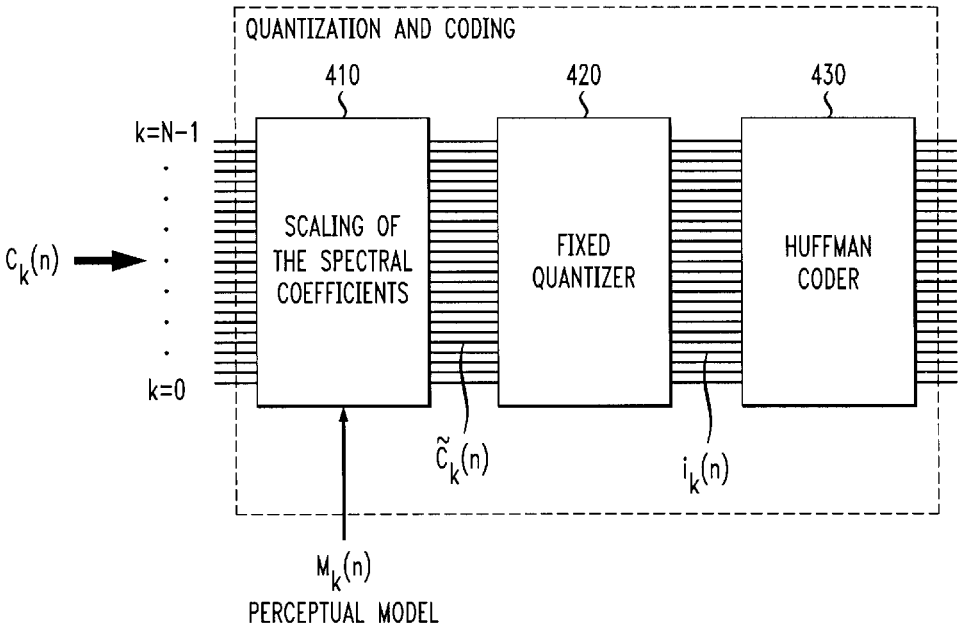
FIG. 4 illustrates the quantizer and coder from FIG. 1 in further detail.

FIG. 4 illustrates the quantizer and coder 130 from FIG. 1 in further detail. The quantizer 130 quantizes the spectral values according to the precision corresponding to the masked threshold estimate. Typically, this is implemented by scaling the spectral values at block 410 before a fixed quantizer is applied at block 420.

Figure 3:
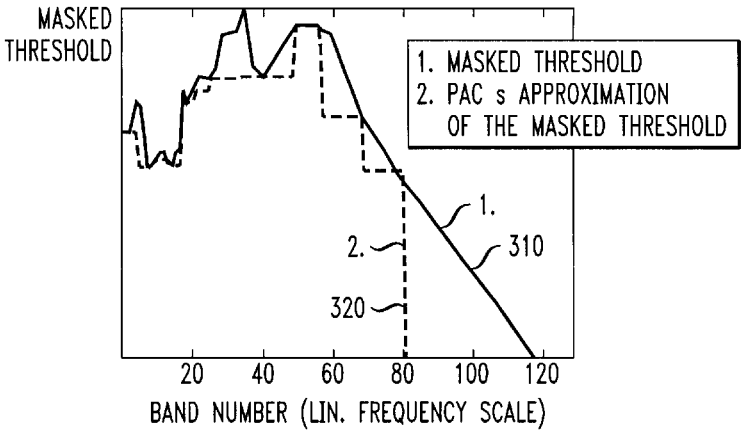
FIG. 3 illustrates a masked threshold and corresponding step function approximation used by the conventional perceptual audio coder of FIG. 1.

In perceptual audio coders, the spectral coefficients are grouped into coding bands. Within each coding band, the samples are scaled with the same factor. Thus, the quantization noise of the decoded signal is constant within each coding band and is a step-like function 320, as shown in FIG. 3. In order not to exceed the masked threshold for transparent coding, a perceptual audio coder chooses for each coding band a scale factor that results in a quantization noise corresponding to the minimum of the masked threshold within the coding band.

The step-like function 320 of the introduced quantization noise can be viewed as the approximation of the masked threshold that is used by the perceptual audio coder. The degree to which this approximation of the masked threshold 320 is lower than the real masked threshold 310 is the degree to which the signal is coded with a higher accuracy than necessary. Thus, the irrelevancy reduction is not fully exploited. In a long transform window mode, perceptual audio coders use almost four times as many scale-factors than in a short transform window mode. Thus, the loss of irrelevancy reduction exploitation is more severe in PAC's short transform window mode. On one hand, the masked threshold should be modeled as precisely as possible to fully exploit irrelevancy reduction; but on the other hand, only as few bits as possible should be used to minimize the amount of bits spent on side information.

Quantization and Noise-Shaping

Audio coders, such as perceptual audio coders, shape the quantization noise according to the masked threshold. The masked threshold is estimated by the psychoacoustical model 120. For each transformed block n of N samples with spectral coefficients $\{c_k(n)\}$ $(0 \leqq k < N)$, the masked threshold is given as a discrete power spectrum $\{M_k(n)\}$ $(0 \leqq k < N)$. For each spectral coefficient of the filterbank $c_k(n)$, there is a corresponding power spectral value $M_k(n)$. The value $M_k(n)$ indicates the variance of the noise that can be introduced by quantizing the corresponding spectral coefficient $c_k(n)$ without impairing the perceived signal quality.

As shown in FIG. 4, the coefficients are scaled at stage 410 before applying a fixed linear quantizer 420 with a step size of Q in the encoder. Each spectral coefficient $c_k(n)$ is scaled given its corresponding masked threshold value, $M_k(n)$, as follows:

$$\tilde{c}_k(n) = \frac{Q}{\sqrt{12M_k(n)}} c_k(n), \tag{1}$$

The scaled coefficients are thereafter quantized and mapped to integers $i_k(n)=\text{Quantizer}(\tilde{c}_k(n))$. The quantizer indices $i_k(n)$ are subsequently encoded using a noiseless coder 430, such as a Huffman coder. In the decoder, after applying the inverse Huffman coding, the quantized integer coefficients $i_k(n)$ are inverse quantized $q_k(n)=\text{Quantizer}^{-1}(i_k(n))$. The process of quantizing and inverse quantizing adds white noise $d_k(n)$ with a variance of $\sigma_d=Q^2/12$ to the scaled spectral coefficients $\tilde{c}_k(n)$, as follows:

$$q_k(n)=\tilde{c}(n)+d_k(n), \tag{2}$$

In the decoder, the quantized scaled coefficients $q_k(n)$ are inverse scaled, as follows:

$$\tilde{c}_k(n) = \frac{\sqrt{12M_k(n)}}{Q} q_k(n) = c_k(n) + \frac{\sqrt{12M_k}(n)}{Q} d_k(n), \tag{3}$$

The variance of the noise in the spectral coefficients of the decoder $$\left(\sqrt{\frac{\sqrt{12M_k(n)}}{Q}} d_k(n) \text{ in Eq. } 3\right)$$

is $M_k(n)$. Thus, the power spectrum of the noise in the decoded audio signal corresponds to the masked threshold.

Modeling of the Masked Threshold

As previously indicated, according to one feature of the present invention, the masked threshold is initially modeled with linear prediction (LP) coefficients.

Masked Threshold Viewed as a Power Spectrum

A masked threshold over frequency gives, for each frequency, the amount (power) of noise that can be added to the signal without being perceived. In other words, the masked threshold is the power spectrum of the maximum shaped noise that cannot be heard if simultaneoulsy presented with the original signal.

As shown in FIG. 3, the masked threshold 310 is much more detailed for lower frequencies, due to how the human auditory system works and the fact that for most sounds the energy is concentrated at low frequencies. Most perceptual models compute the masked threshold in a partition scale. A partition scale is an approximation of the bark scale. The linear frequency scale can be mapped to the partition scale by a frequency warping function W, $$\omega = W(\omega), \tag{4}$$

with W (0)=0 and W (π)=π. The masked threshold in linear scale is M(ω) and is computed from the masked threshold in partition scaled as follows:

$$M(\omega)\left|\frac{\delta W(\omega)}{\delta\omega}\right|^{-1} \tilde{M}(W(\omega)) \tag{5}$$

Modeling of a Power Spectrum with Linear-Prediction

W. B. Kleijn and K. K. Paliwal, "An Introduction to Speech Coding," in Speech Coding and Synthesis, Amsterdam: Elsevier (1995), incorporated by reference herein, describes how a power spectrum, such as the masked threshold, can be modelled with LP (linear prediction) coefficients.

It can be shown that:

$$\sum_{n=0}^{n=L+N-1} \{e(n)\}^2 = \frac{1}{2\pi}\int_{-\pi}^{\pi} \frac{S(\omega)}{\hat{S}(\omega)} \tag{11}$$

where e(n) is the prediction error, and S(ω) and Ŝ (ω) represent the power spectrum of the signal and the impulse response of the all-pole filter, respectively. The scaled power spectrum of the all-pole filter (ω) is an approximation of the power spectrum of the original signal (ω), $$S(\omega) \approx a\hat{S}(\omega) \tag{12}$$

Thus, LP coefficients $\{a_m\}$ ($1 \leqq m \leqq N$) and the constant $$a = \frac{\int_{-\pi}^{\pi} S(\omega)d\omega}{\int_{-\pi}^{\pi} \hat{S}(\omega)d\omega} \tag{13}$$

can represent an approximation of a power spectrum.

Modeling of the Masked Threshold with LP Coefficients

The all-pole filter models the masked threshold best in the linear frequency scale from an MSE point of view. The high detail level at low frequencies, however, is not modeled well. Since most of the energy is located at low frequencies for most audio signals, it is important that the masked threshold is modeled accurately at low frequencies. The masked threshold in the partition scale domain is smoother and therefore can be modeled better with the all-pole filter.

However, at high frequencies, the masked threshold is modeled with less accuracy in partition scale than in linear scale. But less accuracy in the high frequency parts of the masked threshold has only little effect because only a small percentage of the signal energy is normally located there. Therefore, it is more important to model the masked threshold better at low frequencies and as a result modeling in partition scale is better.

The psychoacoustic model calculates the N masked threshold values in bands of equal width on the partition scale, with center frequencies, $$\tilde{\varpi}_k = \left(k - \frac{1}{2}\right)\cdot\frac{\pi}{N} \quad 0 \le k \le N. \tag{14}$$

For each band, the psychoacoustic model calculates a threshold value, $\tilde{M}(\omega_1), \tilde{M}(\omega_2), \tilde{M}(\omega_3), \ldots, \tilde{M}(\omega_N)$.

The masked threshold in partition scale is treated like a power spectrum in a linear frequency scale. Thus, the LP coefficients can be calculated from the masked threshold with efficient techniques from speech coding. The autocorrelation of the masked threshold (power spectrum) is needed to calculate the LP coefficients.

The masked threshold values from the psychoacoustic model, $S_k = \tilde{M}(\omega_k)$, are given for frequencies shifted by $$\frac{\pi}{2N}$$

to the right, according to equation 14, in comparison to a power spectrum computed by the Discrete Fourier Transform of an autocorrelation function. The autocorrelation of the masked threshold power spectrum is $$R(n) = F^{-1}(S_k)e^{j\frac{\pi}{N}n} \tag{15}$$

Representing the LP Coefficients as Line Spectrum Frequencies

Line Spectrum Frequencies, as described in F. K. Soong and B.-H. Juang, "Line Spectrum Pair (LSP) and Speech Data Compression," in Proc. IEEE Int. Conf. Acoust., Speech, Signal Processing, pp. 1.10.1–1.10-4, (March 1984), incorporated by reference herein, are a known alternative LP coefficients spectral representation. From a minimum-phase filter, A(z), two polynomials are computed $$P(z)=A(z)+z^{-(m+1)}A(z)$$

$$Q(z)=A(z)-z^{-(m+1)}A(z)$$

The LSF (line spectrum frequencies) are the zeros of the two polynomials P(z) and Q(z). Three interesting properties of these two polynomals are listed as follows:

All zeros of P (z) and Q(z) are on the unit circle

Zeros of P (z) and Q(z) are interlaced with each other

The minimum phase property of A(z) is easily preserved after quantization of the zeros of P(z) and Q(z) by maintaining the ordering in frequency.

The present invention recognizes that the LSF parameters can be computed efficiently due to these properties. Moreover, the stability of the resulting all-pole filters can be verified because of the ordering property. From the literature in speech coding, it has been demonstrated that the quantization properties of the LSF parameters are good because they localize the quantization error in frequency.

Figure 5:
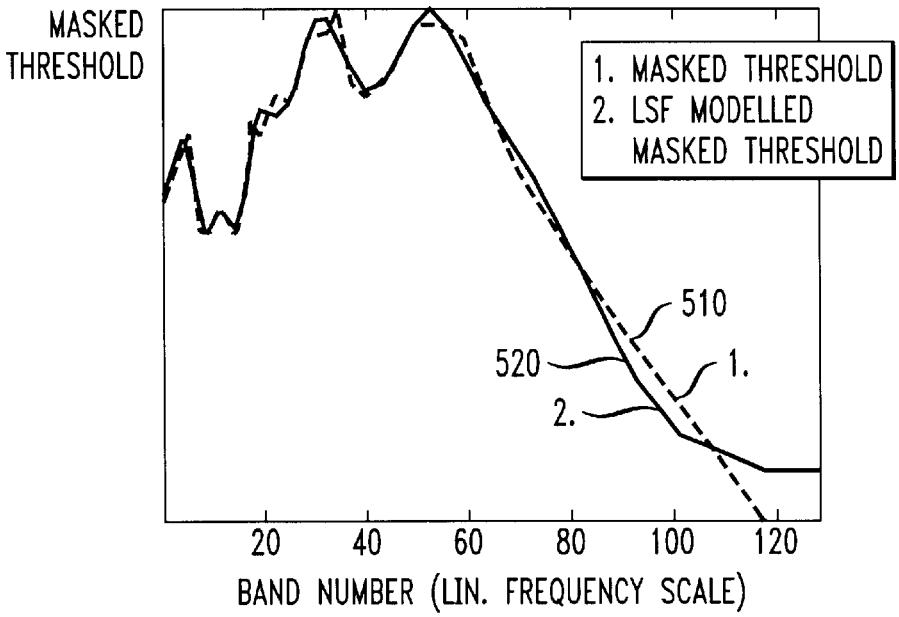
FIG. 5 illustrates a masked threshold computed according to a psychoacoustic model, and the corresponding line spectral frequency (LSF) approximation of the masked threshold in accordance with the present invention.

FIG. 5 illustrates the masked threshold 510 computed according to a psychoacoustic model, and the LSF approximation 520 of the masked threshold in accordance with the present invention. The LSF approximation 520 uses only half the number of bits compared to the conventional step function representation of the masked threshold, shown in FIG. 3.

Figure 6:
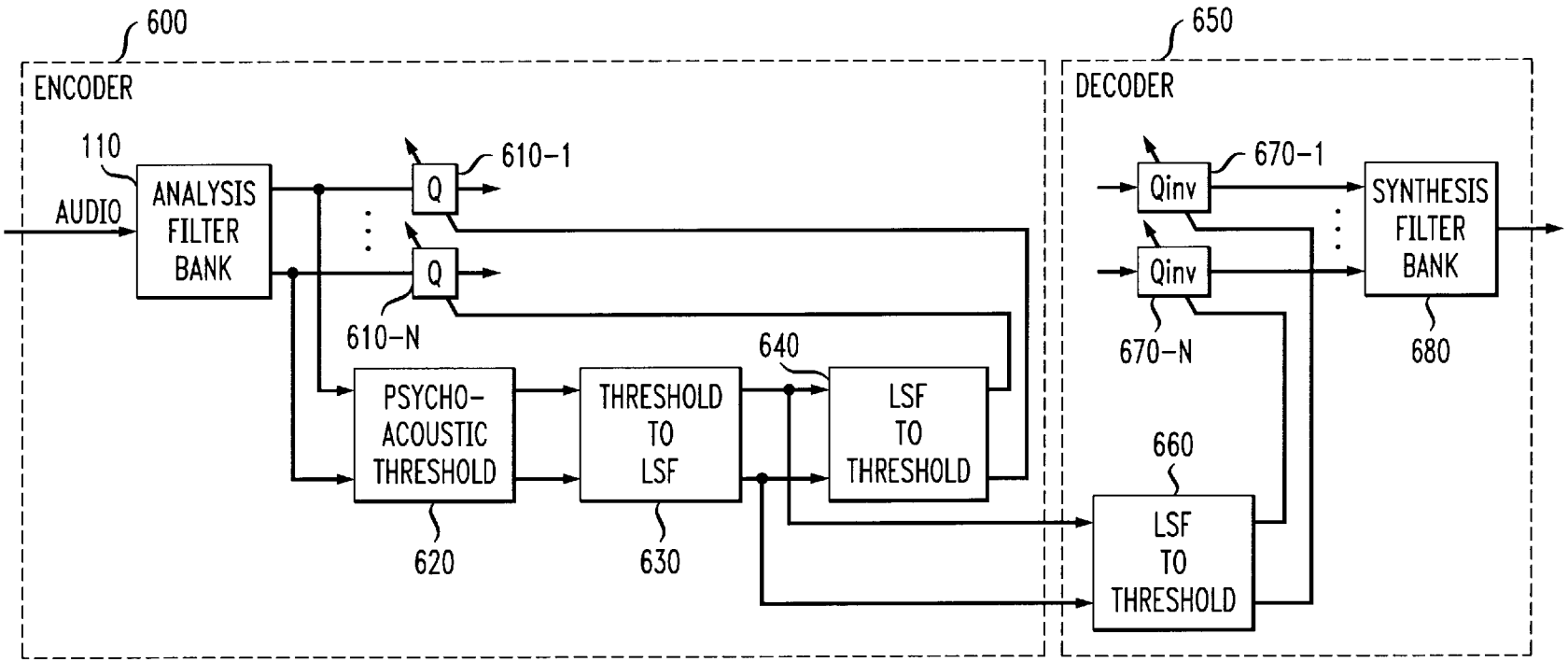
FIG. 6 is a schematic block diagram of a perceptual audio coder and corresponding perceptual audio decoder in accordance with the present invention.

FIG. 6 is a schematic block diagram of a perceptual audio coder 600 and corresponding perceptual audio decoder 650 in accordance with the present invention. The perceptual audio coder 600 includes an analysis filterbank 110 and quantizers 610 that operate in a conventional manner. As shown in FIG. 6, the masked thresholds 620, generated in accordance with the psychoacoustic model, are converted to an LSF representation at stage 630 in the manner described above. The LSF parameters are transmitted from stage 630 to the perceptual audio decoder 650 and used to reconstruct the masked threshold.

In addition, the LSF parameters generated at stage 630 are used to reconstruct the masked threshold at stage 640 in the encoder and at stage 660 in the decoder 650. The masked thresholds control the step sizes of the quantizers 610 and the inverse quantizers 670. The LSF coefficients are transmitted to the decoder 650 as part of the side information, together with the subband signals.

Time Modeling of the Masked Threshold

In order to save bits, the masked threshold does not need to be transmitted for each adjacent time window. In between transmitted masked thresholds, interpolation is used to approximate masked thresholds that are not transmitted. When a perceptual audio coder is operating in a long transform window mode (1024 MDCT), the percentage of bits used to transmit the masked threshold is relatively small. A masked threshold is transmitted to the decoder once for every block of 1024 samples. When the perceptual audio coder is operating in a short transform window mode (128 MDCT), however, the perceptual audio coder needs to transmit a masked threshold to the decoder eight times more often (for every block of 128 samples). To prevent transmitting the masked threshold for every short block, a perceptual audio coder only transmits a masked threshold if the short-term spectrum changes significantly and keeps the previous masked threshold for blocks where it is not transmitted.

In order to achieve a more accurate approximation of the masked threshold over time, however, it seems more appropriate to base such a decision on the temporal behavior of the masked threshold rather than on short-term spectra.

The present invention utilizes a new scheme that does not transmit each masked threshold. The present invention decides which masked thresholds to transmit based on the change of consecutive masked thresholds, instead of the variation of short-term spectra. Additionally, between transmitted masked thresholds an interpolation scheme is used to improve the accuracy.

For signal parts that gradually change, the masked threshold changes gradually as well and can be approximated by interpolation, as shown in FIG. 7*a*. For a generally stationary signal part, followed by a sudden change, the masked threshold can be approximated by a constant masked threshold that changes at once, as shown in FIG. 7*b*. A relatively constant masked threshold that later changes gradually can be modeled by a combination of a constant masked threshold followed by interpolation, as shown in FIG. 7*c*. A stationary signal part with a short transient in the middle has a masked threshold that temporarily changes to another value but returns to the initial value. This case can be modeled efficiently by setting the masked threshold after the transient to the masked threshold before the transient, as shown in FIG. 7*d*, and thus not transmitting the masked threshold after the transient.

Figure 7:
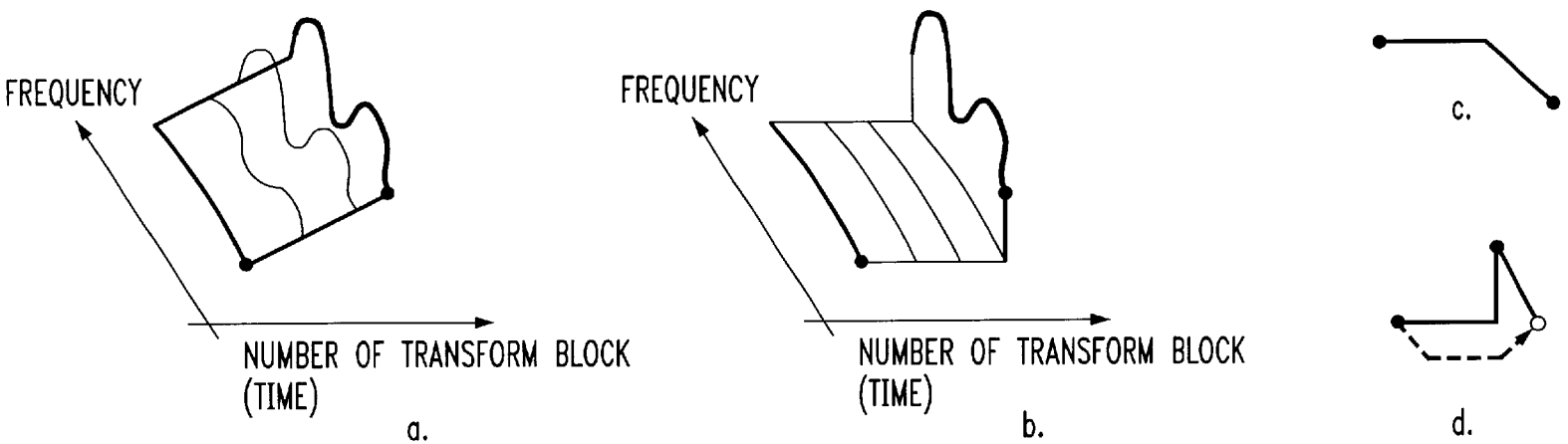
FIGS. 7*a* through 7*d* each illustrate an option for modeling variations in the masked threshold over time.

The mechanism shown in FIG. 7 can be used to model the changes of a masked threshold over time. Instead of transmitting a masked threshold for each transform block, only a few masked thresholds are transmitted and for each other block only a flag is transmitted that signals how to model. So for each block the four possibilities are:

T—Transmit the masked threshold for this block, c—Take the masked threshold of the previous block as the masked threshold for this block (this corresponds to holding the masked threshold constant), i—Interpolate between the previous transmitted masked threshold and the next transmitted masked threshold linearly to compute the masked threshold for this block, P—Take the second last transmitted masked threshold as the masked threshold for this block (this corresponds to what is done in FIG. 7*d*.)

If the time modeling of the masked threshold is deployed on a frame by frame basis, the masked threshold for the first block does not necessarily have to be transmitted. Any modeling option {T, c, I, P} can be chosen for the first block. If, for example, a c is chosen, then the masked threshold of the first block of the frame is the same as the masked threshold of the last block of the last frame.

Implementation in PAC

The scale-factors in a conventional perceptual audio coder 100 are replaced with a LSF representation of the masked threshold in the short transform window mode (128 band MDCT). Using only about half of the bits that were used previously, the masked threshold is modeled much more accurately, as shown in FIG. 5.

The LSFs can be quantized with a 24 bit vector quantizer. Additionally, a contant $\alpha$ (Eq. 13) is transmitted (7 bits). The LSF parameters and a represent the masked threshold. The difference between quantized and non quantized masked thresholds is not audible for the 24 bit vector quantizer. For the time modeling, two bits are reserved for each short block to signal the modeling mode {T,c,i,P}. While the implementation in PACs has been described herein for PAC short blocks, the present invention could be implemented for PAC long and short blocks, as would be apparent to a person of ordinary skill in the art.

It is to be understood that the embodiments and variations shown and described herein are merely illustrative of the principles of this invention and that various modifications may be implemented by those skilled in the art without departing from the scope and spirit of the invention.

We claim:

1. A method for representing a masked threshold in a perceptual audio coder, comprising the steps of:

calculating linear prediction coefficients to model said masked threshold; and converting said linear prediction coefficients to a representation that can be quantized for transmission.

2. The method of claim 1, wherein said representation is a line spectral frequency representation.

3. The method of claim 2, further comprising the step of quantizing said line spectral frequencies for transmission.

4. The method of claim 1, further comprising the step of transforming said linear prediction coefficients to a non-linear frequency scale suitable for auditory properties.

5. The method of claim 1, wherein said masked thresholds control the step sizes of a quantizer.

6. The method of claim 1, further comprising the step of selectively transmitting said masked threshold to a decoder only if a change in said masked threshold from a previous masked threshold exceeds a predefined threshold.

7. The method of claim 6, further comprising the step of approximating a masked threshold that is not transmitted using interpolation techniques.

8. The method of claim 1, wherein said masked threshold is derived from a psychoacoustic model.

9. A method for reconstructing a masked threshold in a perceptual audio decoder, comprising the steps of:

receiving a representation of said masked threshold;

converting said representation to linear prediction coefficients; and deriving said masked threshold from said linear prediction coefficients.

10. The method of claim 9, wherein said masked thresholds are represented using line spectral frequencies.

11. The method of claim 9, wherein said masked thresholds control the step sizes of a dequantizer.

12. The method of claim 9, wherein said masked threshold is received only if a change in said masked threshold from a previous masked threshold exceeds a predefined threshold.

13. The method of claim 9, further comprising the step of approximating a masked threshold that is not received using interpolation techniques.

14. A method for representing a masked threshold in a perceptual audio coder, comprising the steps of:

calculating linear prediction coefficients to model said masked threshold;

converting said linear prediction coefficients to a representation that can be quantized for transmission; and selectively transmitting said masked threshold to a decoder only if a change in said masked threshold from a previous masked threshold exceeds a predefined threshold.

15. The method of claim 14, wherein said change comprises a gradual change in said masked threshold, and wherein said masked threshold is approximated by interpolation.

16. The method of claim 14, wherein said change comprises a gradual change followed by a sudden change in said masked threshold, and wherein said masked threshold is approximated by a constant masked threshold that changes at once.

17. The method of claim 14, wherein said change comprises a generally constant masked threshold that later changes gradually, and wherein said masked threshold is approximated by a constant masked threshold followed by interpolation.

18. The method of claim 14, wherein said change comprises a generally constant masked threshold including a short transient and wherein said masked threshold is approximated by setting the masked threshold after the transient to the masked threshold before the transient.

19. A system for representing a masked threshold in a perceptual audio coder, comprising:

means for calculating linear prediction coefficients to model said masked threshold; and means for converting said linear prediction coefficients to a representation that can be quantized for transmission.

20. A system for reconstructing a masked threshold in a perceptual audio decoder, comprising:

means for receiving a representation of said masked threshold;

means for converting said representation to linear prediction coefficients; and means for deriving said masked threshold from said linear prediction coefficients.

21. A system for representing a masked threshold in a perceptual audio coder, comprising:

means for calculating linear prediction coefficients to model said masked threshold;

means for converting said linear prediction coefficients to a representation that can be quantized for transmission; and means for selectively transmitting said masked threshold to a decoder only if a change in said masked threshold from a previous masked threshold exceeds a predefined threshold.

* * * * *

UNITED STATES PATENT AND TRADEMARK OFFICE

CERTIFICATE OF CORRECTION

PATENT NO. : 6,778,953 B1
DATED : August 17, 2004
INVENTOR(S) : Edler et al.

It is certified that error appears in the above-identified patent and that said Letters Patent is hereby corrected as shown below:

Column 1,
Line 34, before "are" and after "coders" delete -- (PAC) --.

Column 2,
Line 34, before "or" and after "frequencies" delete -- (LSF) --.
Line 35, before "coefficients" and after "prediction" delete -- (LP) --.

Column 3,
Line 24, before "approximation" and after "frequency" delete "(LSF)" .
Line 37, before "As" and after "frequencies" delete "(LSF)".
Line 48, before "or" and after "frequencies" delete "(LSF)".

Column 5,
Line 66, before "is" and after "filter" replace "($\omega$)" with -- $\hat{S}(\omega)$ --.
Line 67, after "signal" replace "($\omega$)" with -- $S(\omega)$ --.

Column 6,
Line 39, after "value," replace "$\tilde{M}(\omega_1), \tilde{M}(\omega_2), \tilde{M}(\omega_3), \ldots, \tilde{M}(\omega_N).$" with -- $\tilde{M}(\varpi_1), \tilde{M}(\varpi_2), \tilde{M}(\varpi_3), \ldots, \tilde{M}(\varpi_N).$ --.

Line 47, before "are" and after "model," replace "$S_k = \tilde{M}(\omega_k)$" with -- $S_k = \tilde{M}(\varpi_k)$ --.

Signed and Sealed this

Thirteenth Day of September, 2005

JON W. DUDAS
*Director of the United States Patent and Trademark Office*